United States Patent [19]

Emody

[11] Patent Number: 4,856,676

[45] Date of Patent: Aug. 15, 1989

[54] POST MIX DISPENSER

[75] Inventor: Kenneth J. Emody, Foxboro, Mass.

[73] Assignee: Jet Spray Corp., Norwood, Mass.

[21] Appl. No.: 92,433

[22] Filed: Sep. 3, 1987

[51] Int. Cl.[4] ..... B67D 5/56

[52] U.S. Cl. ..... 222/66; 222/129.1; 222/146.6; 222/148; 222/325; 222/333; 222/505; 285/305; 137/240; 251/148

[58] Field of Search ..... 222/94, 95, 105, 129.1–129.4, 222/146.6, 148, 183, 185, 66, 325, 333, 372, 506, 545; 62/389, 390, 394; 251/148, 152; 137/240, 625.41; 285/305, 308; 141/198, 346, 383, 386; 604/248, 249, 262, 245

[56] References Cited

U.S. PATENT DOCUMENTS

| | | | |
|---|---|---|---|
| Re. 32,354 | 2/1987 | Savage . | |
| 1,951,121 | 3/1934 | Babcock | 251/148 |
| 2,338,759 | 1/1944 | Fortune | 251/148 X |
| 3,081,911 | 3/1963 | Scholle | 222/105 X |
| 3,782,429 | 11/1974 | Barber | 222/66 X |
| 4,008,832 | 2/1977 | Rodth | 222/129.1 |
| 4,076,279 | 2/1978 | Klotz et al. | 285/305 X |
| 4,169,543 | 10/1979 | Hall | 222/64 X |
| 4,288,007 | 9/1981 | Rogers | 222/66 |
| 4,333,505 | 6/1982 | Jones et al. | 141/383 |
| 4,375,864 | 3/1983 | Savage | 222/105 X |
| 4,610,145 | 9/1986 | Arzberger et al. | 222/146.1 X |
| 4,645,095 | 2/1987 | Coppola | 222/64 |
| 4,703,770 | 11/1987 | Arzberger et al. | 222/333 X |

FOREIGN PATENT DOCUMENTS

| | | | |
|---|---|---|---|
| 0159118 | 2/1985 | European Pat. Off. . | |
| 0176259 | 8/1985 | European Pat. Off. . | |
| 728252 | 4/1955 | United Kingdom | 251/148 |
| 2098963 | 12/1982 | United Kingdom . | |

*Primary Examiner*—Kevin P. Shaver
*Assistant Examiner*—Gregory L. Huson
*Attorney, Agent, or Firm*—Wolf, Greenfield & Sacks

[57] ABSTRACT

A post mix dispenser having a refrigerated cabinet at the top which houses separate containers for different juice concentrates. The machine mixes potable water with the concentrate on demand. The potable water is cooled in an ice bath at the rear of the cabinet, in the same refrigeration system which cools the ice bath provides a source for cooling air circulated in the cabinet about the concentrate containers. The concentrate containers each are of rigid box member construction having supported therein a liquid-type bag member with an outlet member. The containers are coupled to a beverage discharge assembly by a concentrate pump and a concentrate control valve that provides for quick-disconnect operation.

29 Claims, 8 Drawing Sheets

50
9
255
6
210
76
240
206
244
5
280
282
5
248
6
269
251
250
4
81
4
79
77
200
290
E2
78
9
30

282
248
280
RUN →
244
206
269
278
← RINSE
PULL
279
279
250
251
204
200

282
280
240
270
275
276
206
274
244
242
264
276
268
248
259
256
257
279
279
250
254
246
252
204
200
E1
205

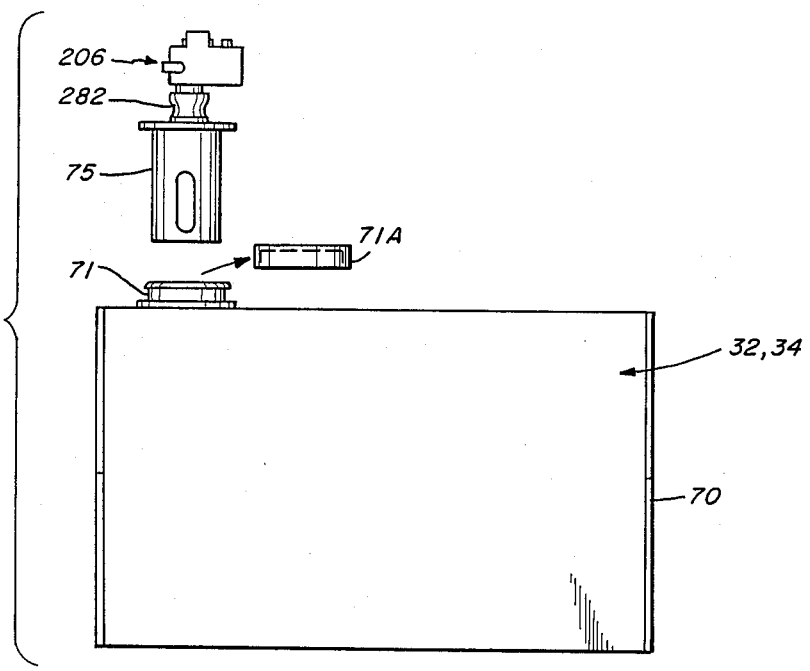
Fig. 11
Fig. 12
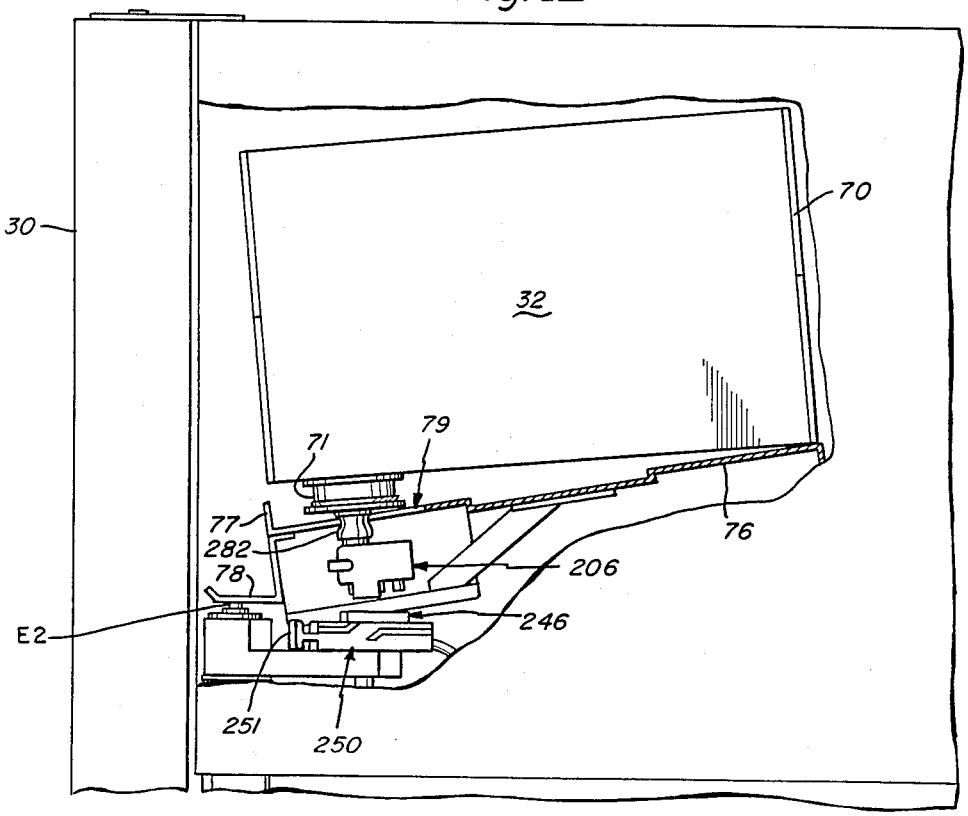

POST MIX DISPENSER

BACKGROUND OF THE INVENTION

1. Field of the Invention

The present invention relates in general to a beverage dispenser and pertains, more particularly, to a post mix dispenser preferably for dispensing fruit juice, although it may also be used for dispensing other types of beverages. Even more particularly the present invention relates to a post mix dispenser in which the concentrate container is preferably in the form of a bag-in-box container.

2. Background Discussion

Reference is now made herein to the present assignee's previously issued related U.S. Pat. No. 4,610,145 on a post mix fruit juice dispenser employing one or more refillable concentrate containers that may be removed from the dispensing machine but that are adapted to be refilled without opening the front door of the machine.

Also refer to the assignee's co-pending application Ser. No. 590,992, filed Mar. 19, 1984, entitled Self-Fill System and relating to a dispenser with an automatic fill feature, and application Ser. No. 590,994, filed Mar. 19, 1984 now U.S. Pat. No. 4,645,095, entitled Syrup Sensor For Dispensing Machine, and relating to a sensor for detecting an out-of-syrup condition.

As indicated previously, the dispenser disclosed in U.S. Pat. No. 4,610,145 is adapted to contain concentrate containers that may be refilled. It is an object of the present invention to provide a post mix dispenser that is particularly adapted to receive concentrate containers that are bag-in-box containers.

Another object of the present invention is to provide a post mix dispenser having an improved concentrate control valve arrangement.

Another object of the present invention is to provide an improved post mix dispenser in which the bag-in-box is readily removed and replaced even by a totally unskilled user.

Still another object of the present invention is to provide an improved post mix dispenser that is characterized by easy access to the machine preferably through a front hinged door of the machine so as to permit the ready changing of the bag-in-box container.

Still a further object of the present invention is to provide an improved post mix dispenser that has an improved out-of-syrup sensor arrangement.

Another object of the present invention is to provide an improved means for introducing a new bag-in-box to the dispenser in which the concentrate control valve is secured with the bag outlet with the valve in its closed position to prevent any concentrate from escaping from the container.

SUMMARY OF THE INVENTION

To accomplish the foregoing and other objects, features, and advantages of the invention there is provided a post mix dispenser, preferably for fruit juice concentrate and particularly adapted to receive bag-in-box type containers. The post mix dispenser of the invention is adapted to maintain the concentrate at say 40° F. and is provided preferably with two bag-in-box containers in which may be provided separate types of concentrate. The dispensing machine includes a refrigeration system for maintaining the temperature of the concentrate at the desired level and for furthermore chilling the potable water mixed with the concentrate on demand for a beverage. When the concentrate falls below a certain level, a sensor disables the beverage discharge assembly for that particular beverage.

The cabinet in which the bag-in-box containers are stored is an insulated cabinet that is preferably provided with a hinged front door. This provides easy access to the concentrate storage compartment so that either or both of the containers can be readily removed and replaced.

In accordance with another feature of the present invention there is provided an improved means for coupling the bag-in-box container to the concentrate pump. This includes the use of an improved concentrate control valve that is coupled to the bag-in-box outlet. The concentrate control valve is connected to the bag-in-box container outside of the dispenser and the valve is maintained in a closed position so that no concentrate can escape therefrom. With the arrangement in this position the bag-in-box is placed onto the support shelf inside the dispenser and is connected and locked to the inlet side of the pump. The concentrate control valve may then be opened.

To start the unit, which will not run unless there is concentrate in the concentrate sensor, a prime switch for each side is mounted in the control compartment at the bottom of the inner door. The appropriate button (prime switch) is pressed for starting the pump. In a short period of time, concentrate reaches the sensor and then flows out the nozzle indicating it is primed and ready for dispensing. At the same time, the out-of-concentrate light on the door goes out indicating that the unit is now ready to dispense. By way of example, a one-gallon bag of concentrate serves a maximum of one hundred and twenty-eight (128) five (5) ounce cups of juice from a 4:1 juice concentrate. In reality, this maximum is not attained because not all of the concentrate can be pumped from the bag. This is primarily because the bag is supported at a slight angle on a tilted support shelf. However, with the outlet valve in the bag-in-box properly positioned very little residue remains when the system shuts down, about 3 ounces.

In accordance with a further feature of the present invention there is provided a very reliable out-of-concentrate sensor disposed very efficiently over the pump inlet manifold. This sensor is generally of the type described in U.S. Pat. No. 4,645,095, although the sensor described herein is of further improved construction particularly as it applies to the dispensing of bag-in-box concentrate. The sensor operates on the principal of a control circuit being maintained in operation by the flow of current through the filled concentrate circuit. When the bag-in-box is empty, the concentrate level drops, breaking the circuit and shutting down the unit while at the same time turning on an out-of-concentrate light on the front of the door. Shut down occurs within a drink or so after the measured Brix drops in the dispensed drink, preventing the operator from continuing to serve weak drinks.

The circuit for detecting an out-of-concentrate condition is comprised of two electrodes. One electrode is sealed inside the tube that connects to the concentrate control valve and is located directly under the concentrate control valve. The mounting is such that the connecting line which ties into the out-of-concentrate sensor can be lifted off this electrode for cleaning. An O-ring assures a seal. The other electrode is located in the out-of-concentrate sensor. The connection with the sensing circuit is made by the box support plate which rests on the electrode by a support tab welded to the plate. The circuit is completed by the plate contacting an electrode on the liner side.

In accordance with the present invention, the entire arrangement that feeds the concentrate leading to the pump as well as other parts of the machine are constructed so that they can be easily disassembled without requiring any tools for cleaning, which is of course essential in the food service industry. The bag-in-box is easily installed and connected and likewise easily disconnected and removed. Any drippage of product is almost nonexistent due primarily to the presence of the concentrate control valve.

In summary, in accordance with the invention, there is provided a beverage dispenser that is comprised of a housing including a base and an insulated cabinet disposed on the base. An ice bath is disposed at the rear of the cabinet and at least one concentrate container is disposed in the front of the cabinet. In a preferred embodiment of the invention, there is provided a metal shelf upon which there are actually disposed two concentrate containers. In accordance with the invention, the preferred container comprises a rigid box member having supported therein a liquid-tight bag member for storing the concentrate and further having coupling therefrom an outlet member. There is provided a beverage discharge assembly including a mixing block and a dispensing nozzle. Potable water is coupled to the mixing block. A concentrate pump is provided supported in the housing between the outlet from the concentrate container and the mixing block. At the inlet side of the concentrate pump there is disposed a concentrate control valve for coupling the container outlet member to the concentrate pump. The concentrate control valve in accordance with the invention comprises separate quick-disconnect members including a first member which is a base member and which is held stationary in the housing and a second member that includes an operating member adapted to be held to the container outlet member for quick-disconnect mating with the first member.

BRIEF DESCRIPTION OF THE DRAWINGS

Numerous other objects, features, and advantages of the invention should now become apparent upon a reading of the following detailed description taken in conjunction with the accompanying drawings, in which:

FIG. 11 is a schematic diagram illustrating the manner in which the concentrate control valve and adapter are secured to the concentrate container;

FIG. 12 is a partially broken away side elevation view of the dispenser of this invention showing the bag-in-box being inserted on its accommodating shelf with the concentrate control valve closed so that there will not be any leakage and with the concentrate control valve about to be seated with its base slide.

DETAILED DESCRIPTION

Figure 1:
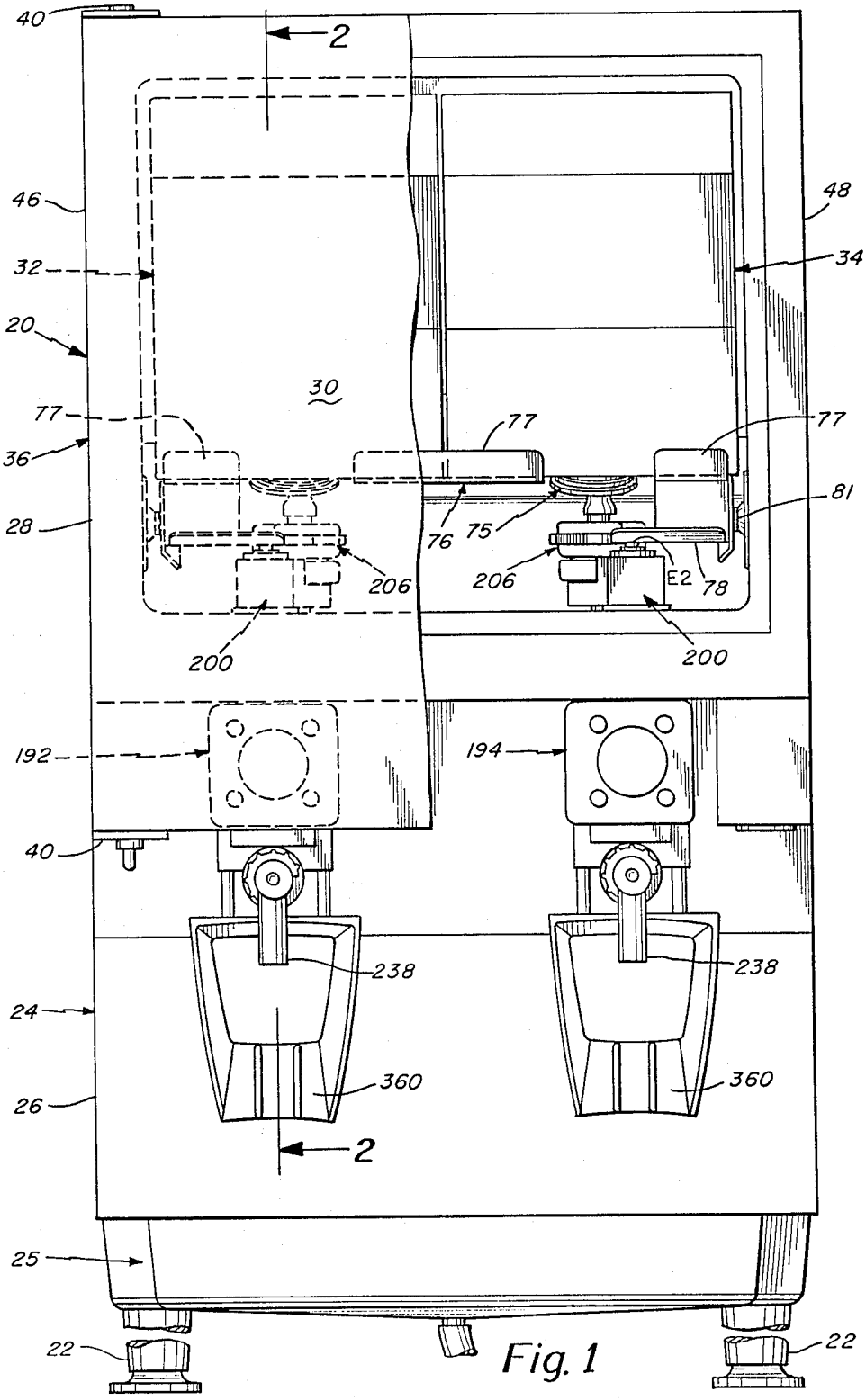
FIG. 1 is a front elevation view, with parts broken away, of a beverage dispenser constructed in accordance with the present invention.

The beverage dispenser of the present invention is a post mix machine that is adapted to combine beverage concentrate such as orange juice concentrate with cold water and discharge the mixture on demand. Most typically, when a machine is used as a fruit juice dispenser it may be used for dispensing metered quantities of two separate fruit juices such as orange juice and grapefruit juice. However, it is understood that the principals of the present invention may also be employed in other beverage dispensing applications.

The beverage dispenser illustrated in the drawings is intended to be placed on a counter-top or table, and its overall dimensions may be, in one embodiment, 27" high, 14" wide and 23" deep. The dispenser includes a housing 20 supported by four legs 22 attached to the base 24 of the housing adjacent its four corners. Base 24 also carries a drip tray 25. The housing 20 has a lower portion 26 which contains a substantial part of the dispenser refrigeration system including the compressor and condenser, as well as the dispenser controls and part of the potable water system. The upper portion 28 of the dispenser has an insulated cabinet 36 closed at its front by a hinged door 30. The insulated cabinet 36 is adapted to contain, at the front thereof, two bag-in-box containers 32 and 34. The door 30 may be held closed by the magnetic latch 31 illustrated in FIG. 2. The containers 32 and 34 are mounted in the insulated cabinet 36 in front of an ice bath 38 located at the rear of the upper portion of the machine. In this regard, note FIG. 2 and the location of the ice bath 38.

Figure 2:
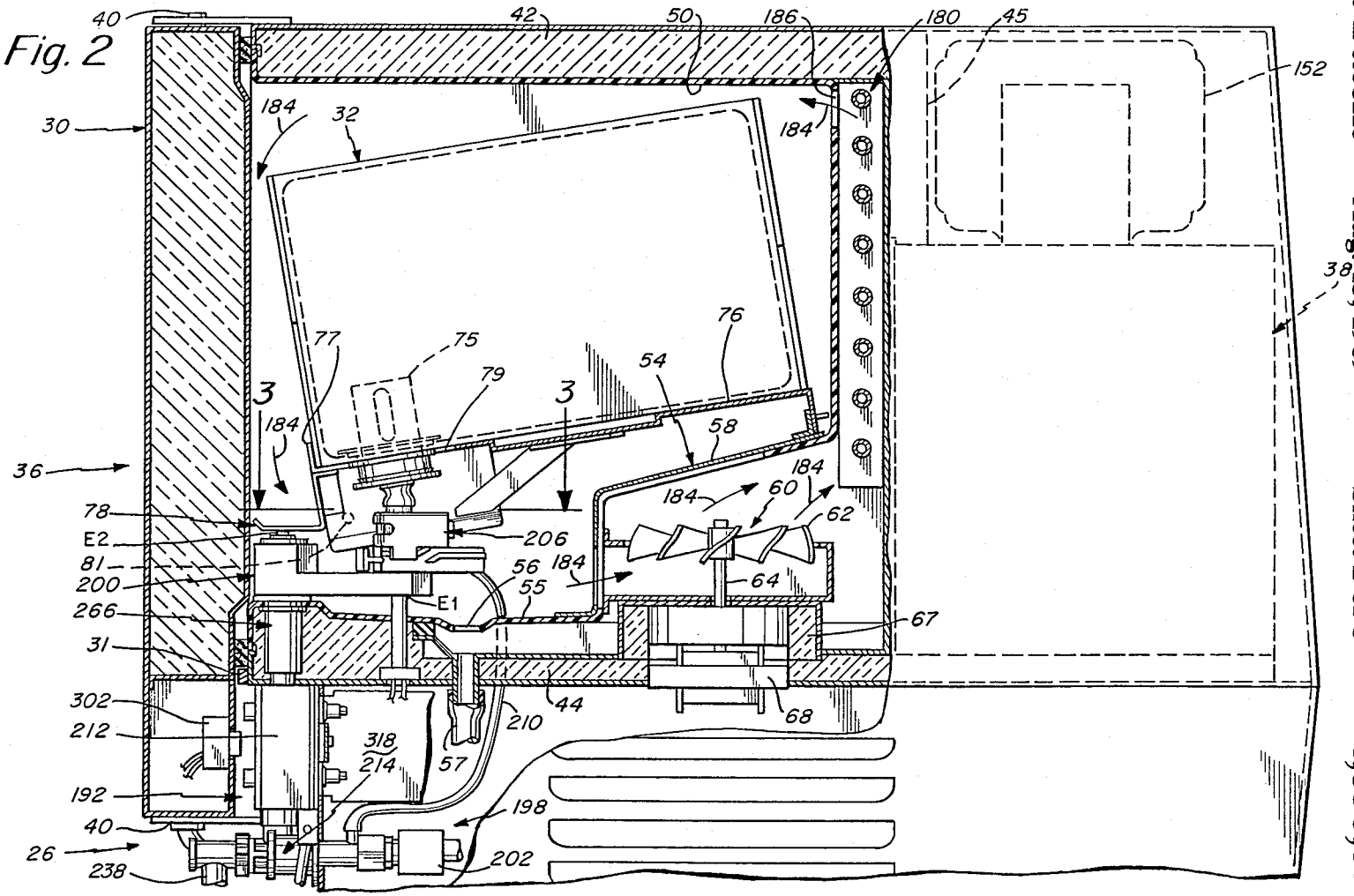
FIG. 2 is a fragmentary cross-sectional view of, in particular, the upper portion of the beverage dispenser as taken along line 2—2 of FIG. 1.

The cabinet 36 is accessible through the hinged door 30 that is carried by the hinges 40. The cabinet 36 is formed at its top by a top wall 42, at the bottom by a bottom wall 44, at the front by the insulation in door 30, at the back by rear wall 45 and on the sides by side walls 46 and 48. The cabinet contains a liner 50 which is open at the front and which receives the two concentrate containers 32 and 34. The bottom wall 54 of the cabinet liner has a lower front section 55 with a drain hole 56 in its center and an elevated rear portion 58 that slants downwardly toward the lower front section 55 of the bottom wall 54. The drain hole 56 is aligned with a drain tube 57 that may be connected to the drip tray 25. The elevated rear portion 58 of the bottom wall of the liner provides room in the cabinet for the fan assembly 60. In FIG. 2 the assembly 60 is shown to include a fan 62 supported for rotation on its vertical shaft 64 which extends through an area of insulation in the raised section 67 of the bottom wall 44 of the cabinet. The shaft 64 is driven by a motor 68 mounted in the recess in the lower surface in the bottom wall 44 defined by the raised section 67. The fan 62 circulates the air in the cabinet to assist in maintaining the concentrates in the containers 32 and 34 at a reduced temperature, preferably 40° F.

Figure 9:
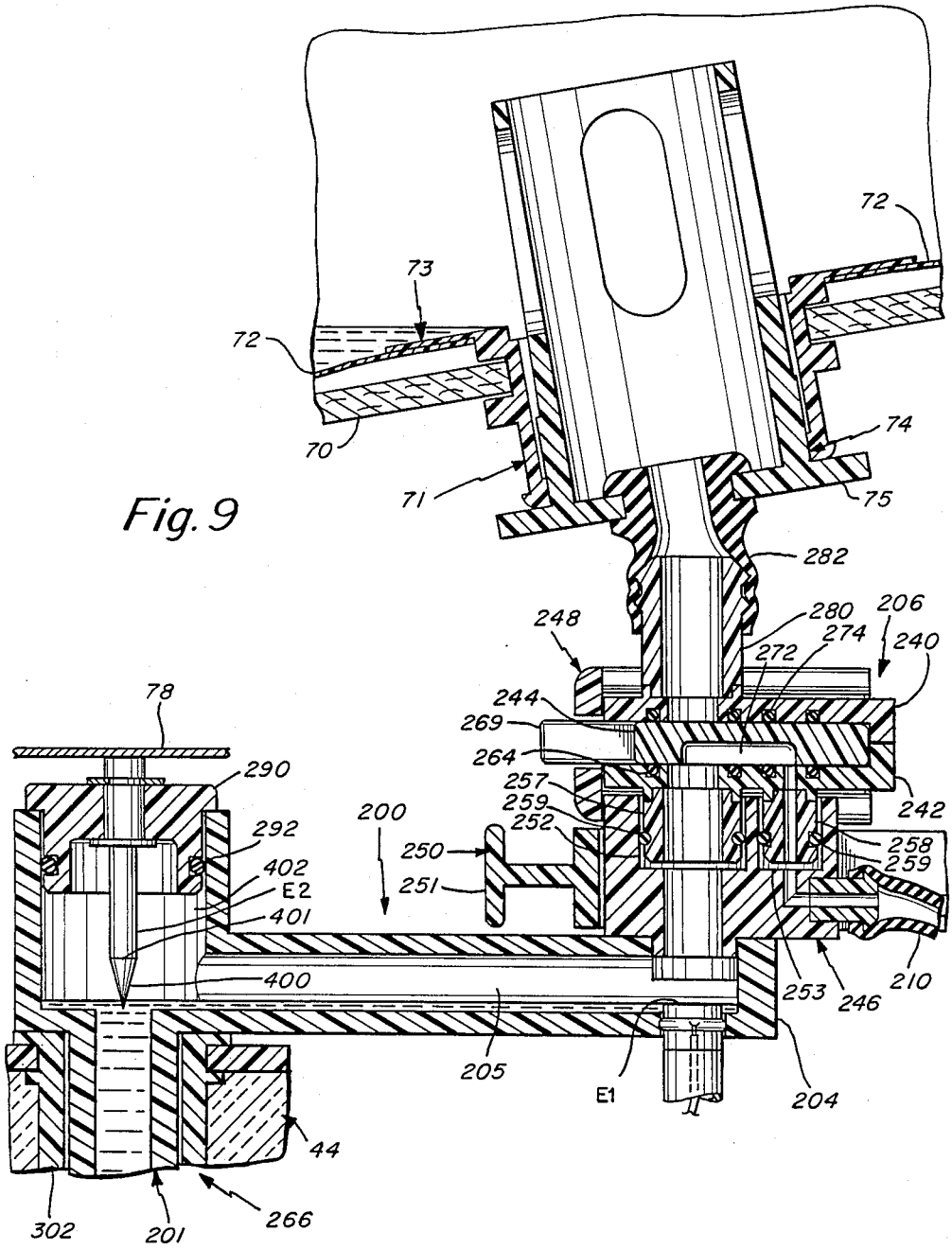
FIG. 9 is a detailed cross-sectional view taken along line 9—9 of FIG. 3 and illustrating the concentrate control valve in its "rinse" position and with the out-of-concentrate sensor at a point where it has almost lost contact between the electrodes.

The preferred form of concentrate container in accordance with the present invention is as illustrated in FIGS. 1, 2, and 9. Also refer to FIGS. 11 and 12 to be described in further detail hereinafter regarding the replacement of containers. These containers are bag-in-box containers and may be adapted to contain a liquid concentrate, usually a juice concentrate such as orange juice concentrate. The bag-in-box construction basically includes an outer cardboard box 70 (see FIG. 9) and an inner disposed plastic bag 72 in which the liquid concentrate is actually contained. FIG. 9 also illustrates the outlet spout 71 that interlocks with the cardboard box 70 and is secured to the plastic bag as illustrated in FIG. 9 at 73. The plastic bag, incidentally, may be a polyethylene bag. The outlet spout 71 is adapted to seal at 74 with the adapter 75 when the adapter is forceably seated in the spout 71. The operation of the adapter 75 in conjunction with the concentration control valve is described in further detail hereinafter. For reference to the seal area 74 refer to FIG. 9.

Figure 3:
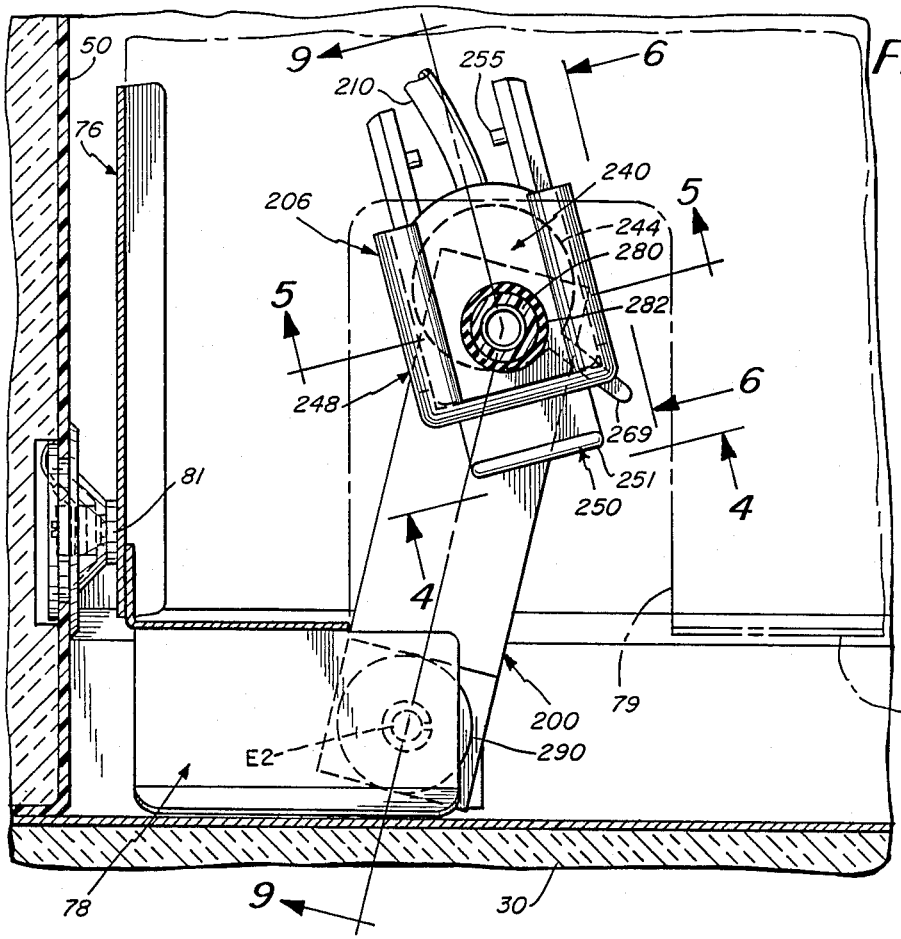
FIG. 3 is a more detailed cross-sectional view taken along line 3—3 of FIG. 2 at the area of the concentrate control valve.

Each of the bag-in-box containers 32 and 34 rests upon a support shelf 76 having at either side thereof, such as is illustrated in FIG. 1, a shelf lip 77. There is also a shelf lip in the middle as illustrated in FIG. 1. The shelf also includes downwardly depending front sections 78 illustrated in FIG. 2 that are adapted to sit upon and contact the respective electrodes E2. The electrode E2 is part of the out-of-concentrate sensor to be described in further detail hereinafter. Also refer to FIG. 3 wherein there is an illustration of the cutout at 79 in the shelf for accommodation of the outlet from the container. Also refer to this cutout 79 in FIG. 2. Also refer to FIG. 3 and the ground contact or terminal 81 which provides a ground return from electrode E2 through the shelf 78 to the terminal 81 and also note the contact E2 in FIG. 9 making the aforementioned contact with the shelf 78.

Reference has been made hereinbefore to the ice bath 38 shown only in dotted outline in FIG. 2. Disposed thereover is the agitator motor 152 that is associated therewith and which also is shown in dotted outline in FIG. 2. The details of the ice bath 38 are not described in detail hereinafter. For further details of this part of the dispenser refer to the assignee's earlier issued U.S. Pat. No. 4,610,145. Generally speaking, the ice bath 38 sits on the insulating bottom wall 44 behind the cabinet liner 50. The ice bath includes a large reservoir. A refrigeration coil lines the inside of the vertical side walls of the reservoir. A second coil for the potable water is disposed in the reservoir inside the refrigerated coil. The refrigeration or evaporator coil is part of the refrigeration system. The refrigeration system also includes a condenser, compressor, drier and heat exchanger that are mounted in the base of the machine. The refrigeration coil as well as an air duct coil 180 illustrated in FIG. 2 are disposed in the cabinet 36 above the base 24.

The ice bath reservoir is filled with water to a level above the top of the refrigeration coil and the potable water coil, and the reservoir is covered by a plate on top of which the agitator motor 152 is mounted. The agitator motor has a shaft that extends into the water bath and carries a bladed impeller that circulates the water about the potable water coils. The support plate for the agitator motor also supports a probe assembly for monitoring build-up of ice in the bath. Again, refer to U.S. Pat. No. 4,610,145 for further specific details of the ice bath portion of the dispensing machine.

Immediately in front of the ice bath reservoir and behind the liner 50 is an air duct coil 180 previously referred to. This carries the refrigerant and is connected in series with the evaporator coil. The air duct coil 180 has an array of cooling fins for achieving forced convection in the cabinet. The fins may be in the form of vertical plates that support the coil 180. The fins are disposed between the rear wall of the liner 50 and the front wall of the reservoir.

In FIG. 2 arrows 184 suggest the path of cooling air for the beverage concentrate. The fan assembly 60 moves the air in the cabinet about a closed loop by pushing the air expelled by it upwardly between the fins of the air duct coil 180, through the ports 186 at the upper end of the rear wall of liner 50, across the top walls of the containers 32 and 34 and between their adjacent side walls and about their remote side walls, down the front of the containers behind door 30 and beneath the containers and tray back to the fan assembly 60. Again, refer to the arrows 184 showing the total closed loop air circulation for maintaining proper temperature control within the cabinet.

The beverage discharge and valve assembly may also be of the type described in U.S. Pat. No. 4,610,145. Refer in particular FIGS. 10 and 12 of that patent. The potable water system includes an inlet which is interrupted by a strainer and a vacuum breaker. The vacuum breaker prevents backup from the dispenser into the potable water supply. The potable water leaving the potable water coil is directed into a duct which divides so as to direct separate water supplies to both sections of the dispenser, that is, the separate beverage discharge assemblies for the separate juices whose concentrates are stored in the containers 32 and 34.

It is noted in FIG. 1 that the container 32 is connected to its discharge system 192 and a separate discharge system 194 is provided for the other container 34. Typically, the assembly 192 may discharge grape or grapefruit juice while assembly 194 may dispense orange juice. Each of these assemblies requires its own potable water supply, and in this connection this is provided by dividing the water into the two separate subsystems or the assemblies 192 and 194, respectively. As the two assembies are identical, only one assembly 192 is described herein.

The potable water is directed through a pressure regulator to a demand solenoid 202 as illustrated in FIG. 2. The water divides sending the potable water in one direction to the discharge nozzle 238 of the discharge assembly 192, and in another direction to the rinse circuit in the concentrate control valve 206 which is to be described in further detail hereinbelow. The pressure regulators for each of the two systems along with the vacuum breaker may be located in the upper portion of the housing above the ice bath of the reservoir for easy access.

The concentrate system includes the concentrate container which contains the concentrated orange juice as well as the concentrate control valve 206 connected to the potable water rinse line 210, a concentrate pump 212, a mixing block 214 where the potable water and concentrate are combined to reconstitute the natural fruit juice, and the discharge nozzle 238. The mixing block 214 is connected to the main flow of water coupling by way of the demand solenoid 202.

In FIG. 2 the potable water system 198 is shown disposed beneath the cabinet 36 in the lower portion 26 of the housing. The syrup system is shown to extend from the concentrate container downwardly from the cabinet 36 through the manifold 266 into the lower portion 26 of the housing where it joins the potable water system.

For further details of the apparatus relating to the concentrate pump and the mixing of syrup and water, refer to U.S. Pat. No. 4,610,145 and in particular FIGS. 3 and 6*a* and the related description therein.

The following is now a discussion of the concentrate control valve 206 as well as the out-of-concentrate sensor 200. Generally speaking, the inlet to the concentration control valve 206 is from the adapter 75 referred to previously and illustrated in FIG. 9. The outlet end 201 of the out-of-concentrate sensor 200, as also illustrated in FIG. 9, couples to the manifold 266. The manifold 266 extends downwardly through a liner bushing 302 which is mounted in the insulating bottom wall 44 of the cabinet of the dispenser. The bottom end of the manifold is connected to the inlet port of the concentrate pump 212. Various O-ring seals may be provided where appropriate and as taught in the aforementioned U.S. Pat. No. 4,610,145.

The pump 212 comprises a pump head having an eccentric pump chamber connected at its top to the pump inlet. An impeller has an array of flexible vanes and is mounted for rotation in the pump chamber driven by the shaft of a pump motor illustrated at 318 in FIG. 2. The chamber is eccentrically located withh respect to the pump vanes to create a low pressure area at the inlet to enable the concentrate to pass into the chamber. The concentrate is discharged from the pump head through an outlet port that is displaced approximately 180° from the inlet. The outlet port discharges to the mixing block 214 where it is mixed with the water for discharge.

In FIG. 1 a pair of push handles 360 are shown connected to the dispensing sytstems for the separate beverages. The left handle 360 shown in that figure controls the discharge of beverage reconstituted from the syrup in container 32 while the right push handle controls the dispensing of beverage reconstituted with the syrup in container 34. The push handles 360 each may carry a magnet which in turn operates a switch in the lower portion of the housing. These switches are in the control circuit and when closed, complete the circuit for the concentrate pump 212 and solenoid valve 202 in the syrup and potable water lines of the respective systems. To draw beverage from the dispenser, the operator need only push the selected push handle toward the housing so as to actuate a particular switch. Release of the handle then deactivates the pump and solenoid.

Figure 10:
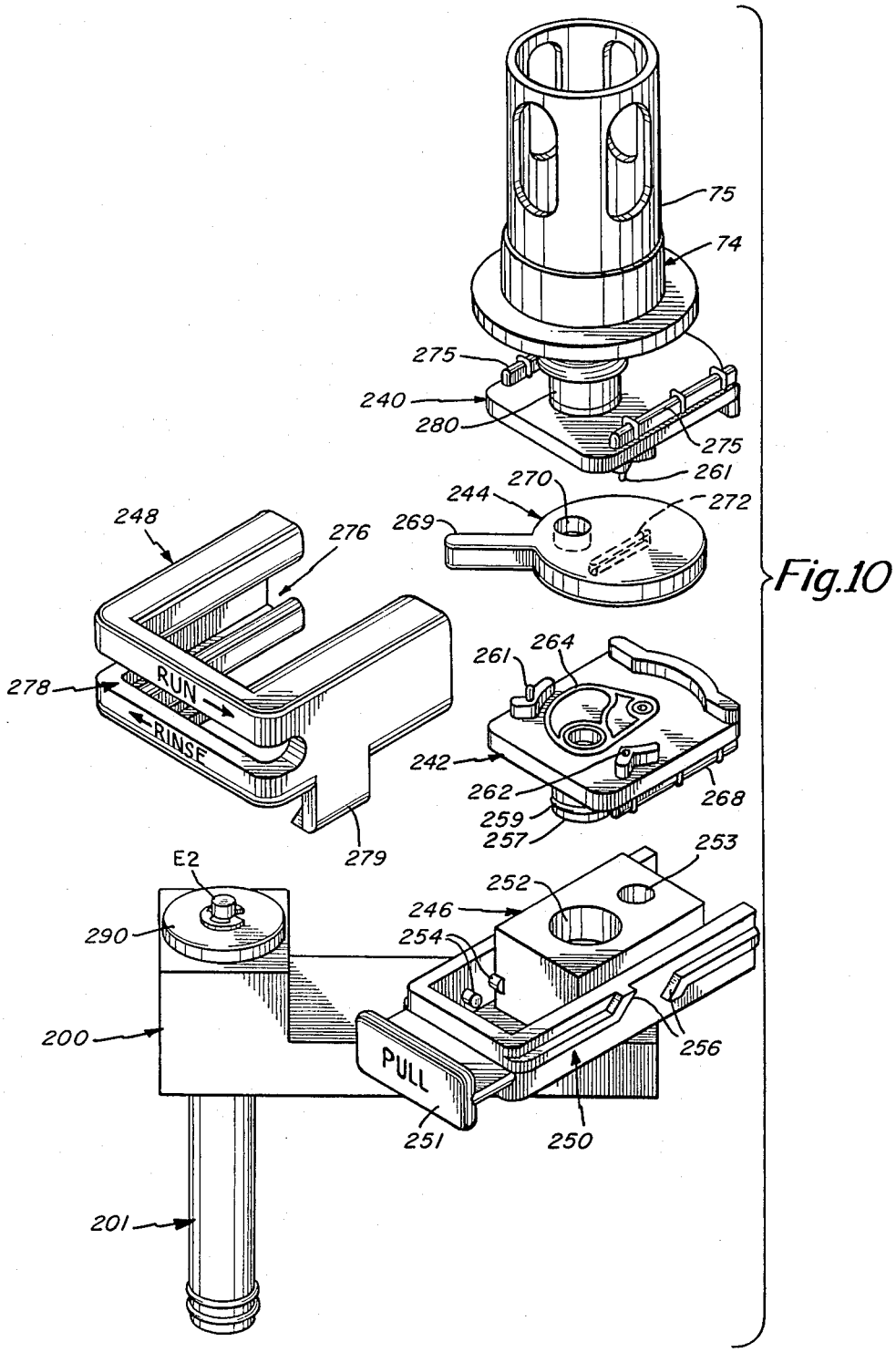
FIG. 10 is an exploded perspective view of the parts of the present invention that essentially connect between the bag-in-box and the concentrate pump including the concentrate control valve, the bag outlet adapter, and the out-of-concentrate sensor.

With respect to the details of the concentrate control valve, refer to FIGS. 4–10. FIG. 10 in particular is an exploded perspective view that clearly shows all of the component parts of the concentration control valve, as well as illustrating a portion of the details of the out-of-concentrate sensor. The concentrate control valve includes a top housing section 240, a bottom housing section 242, control disk 244, and a pair of O-rings to be described in further detail hereinafter. Also illustrated, for example, in FIG. 10 is the support clip 248 and slide member 250 of the valve 206 associated with the base 246.

The base support for the base support for the concentrate control valve includes includes base 246 that may be firmly secured to the out-of-concentrate sensor 200. In this regard, refer to the cross-sectional view of FIG. 9 showing the base 246 supported over the right-hand end 204 of the out-of-concentrate sensor 200. Reference will be made hereinafter to further details of the out-of-concentrate sensor 200 as depicted in detail in FIG. 9.

Figure 5:
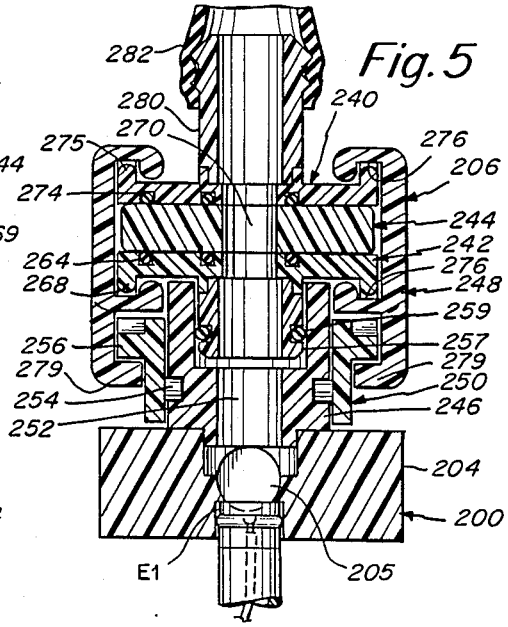
FIG. 5 is a further cross-sectional view taken along line 5—5 of FIG. 3 showing specific details of the concentrate control valve in accordance with the present invention in its "run" position.

As depicted, for example, in FIGS. 5, 9, and 10, the base 246 includes a concentrate passage 252 and a rinse passage 253. The concentrate passage 252 is of larger diameter than the rinse passage 253. The rinse passage 253, as depicted in the cross-sectional view of FIG. 9, is fed from the rinse line 210.

Figure 6:
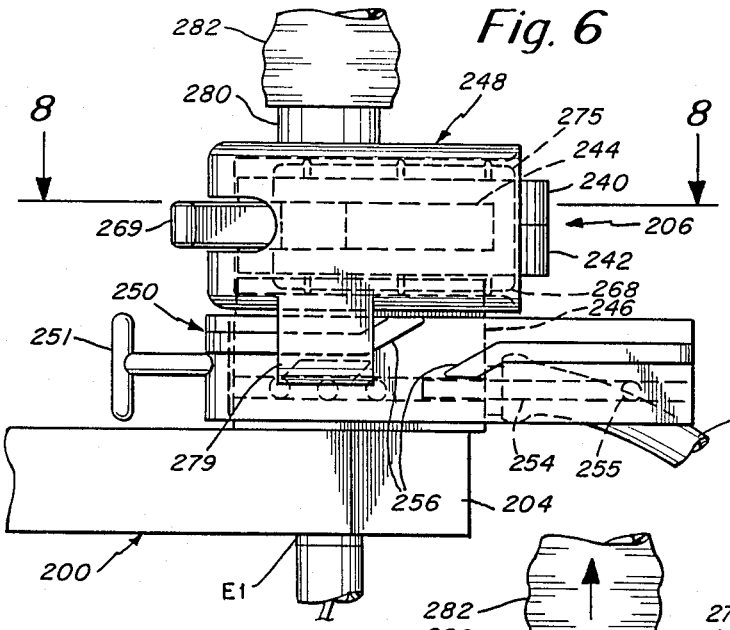
FIG. 6 is a view taken along line 6—6 of FIG. 3 again showing the concentrate control valve in its "run" position.
Figure 7:
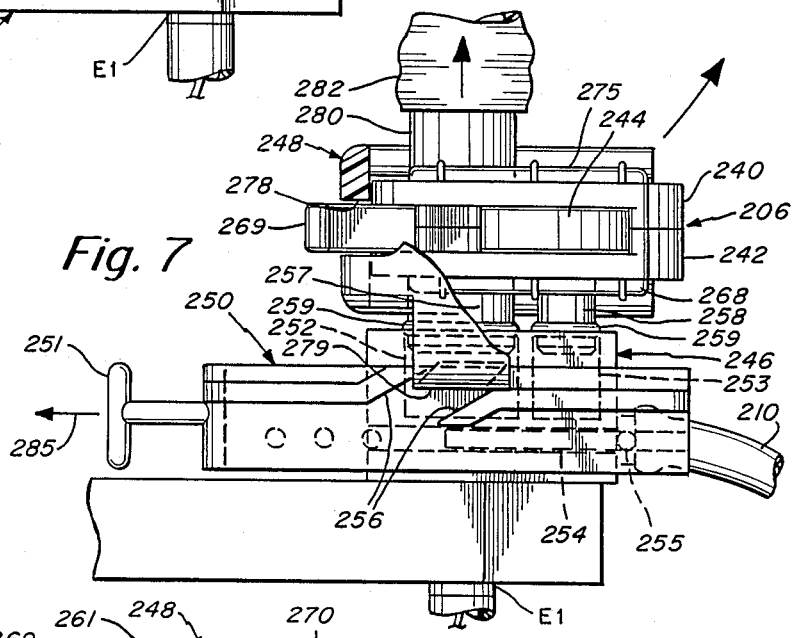
FIG. 7 is a partially cut away view similar to the view of FIG. 6 but with the actuating handle moved to a forward position in which the concentrate control valve is essentially disengaged.

Associated with the base 246 of the concentrate control valve 206 is the slide member 250 that is adapted to move from side to side such as between the two positions illustrated in FIGS. 6 and 7 herein. The slide member 250 operates so as to enable quick-disconnect at the concentrate control valve so as to enable removal and replacement of the bag-in-box container. The slide member 250 has a generally U-shaped construction as depicted in FIG. 10 with a front handle 251 for control thereof. The base 246 has longitudinally extending slots for receiving one or more ribs 254 to guide the slide member in its movement relative to the base 246. The slide member 250 also has a pair of opposed stops 255 that limit the forward position of the slide member. This is the position illustrated in the partially cut-away view of FIG. 7. Note the stop 255 hitting against the rear surface of the base 246.

The base 246 with its associated slide 250 is adapted to be in a fixed position in the machine, although the slide 250 is movable back and forth such as between the positions illustrated in FIGS. 6 and 7 herein. The slide 250 operates by way of the ramps 256 on the opposite sides thereof to permit the concentrate control valve housing to be interlocked with the base or removed therefrom. In the view of FIG. 6 the top and bottom housing sections along with the concentrate control valve disk are all held together by the clip 248 in an interlocked position with the base 246. On the other hand, in the view of FIG. 7 it is noted that the slide handle 251 is moved to the left in that view and by virtue of the cam action causes the concentrate control valve to move upwardly so that it is essentially disengaged from the base 246. Now, in this regard it is noted that the securing clip 248 is instrumental in holding the top and bottom housing sections together along with the concentrate control valve disk 244.

The bottom housing section 242 has depending from the bottom thereof ports 257 and 258. Each of these ports carry sealing O-rings 259. These ports 257 and 258 are accommodated in the respective concentrate passage 252 and rinse passage 253. From the exploded perspective view of FIG. 10, it is readily seen that these ports are coupled into respective concentrate and rinse passages in the bottom housing section 242.

The bottom housing section 242 also includes locating means in the form of a locating pin 261 and a corresponding locating hole 262. The top housing section 240 similarly has a corresponding locating pin and locating hole so that the top and bottom housing sections 240 and 242 can be properly interlocked. In FIG. 10 they are shown in an exploded position while in, for example, FIG. 9 the top and bottom housing sections 240 and 242 are shown interlocked together.

The bottom housing section 242 also carries a specially configured O-ring seal 264 that is adapted to seal between the bottom housing section about the concentrate and rinse passages and against the bottom of the concentrate control valve disk 244.

The bottom housing section 242 also carries on opposite bottom sides thereof slide members 268 that are adapted to interlock with the clip 248. In this regard, note the cross-sectional view of FIG. 5 showing the manner in which the clip 248 interlocks with the oppositely disposed slides 268 of the bottom housing section 242.

Figure 4:
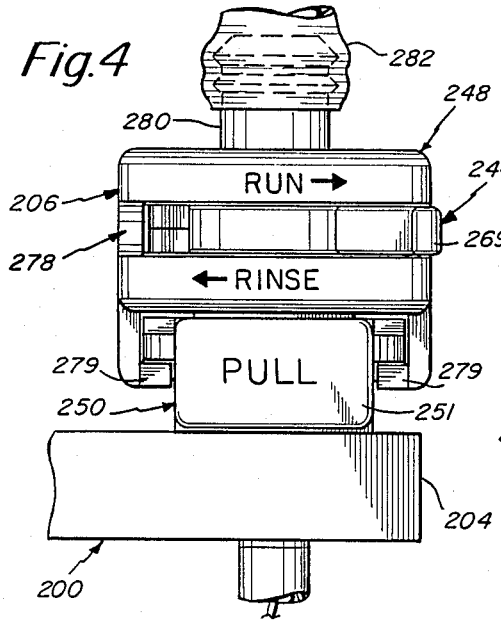
FIG. 4 is a view taken along line 4—4 of FIG. 3 showing essentially a side elevation of the concentrate control valve in its "run" position.

The concentrate control valve disk 244 is basically a disk-shaped having an operating handle 269 and a concentrate passage 270. The passage 270 extends through the control disk. There is also provided a somewhat elongated narrow rinse passage 272 clearly illustrated in FIG. 9. The concentrate control valve in the cross-sectional view of FIG. 9 as a matter of fact is shown in the rinse position so that the rinse passage 272 is shown coupling from the rinse line 210 through the bottom housing section 242, to the passage 272 and from there back to the concentrate passage in the bottom housing section, by way of port 257 through to the base 246 of the concentrate control valve. This, of course, enables rinsing from the rinse line 210 through the concentrate control valve in this particular position of the concentrate control valve. In this regard, also refer to FIG. 4 which shows indicia on the clip 248 indicating the direction for moving the control disk 244, in one direction for the "run" mode of operation and in the opposite direction for the "rinse" mode of operation. In the view of FIG. 4, the control handle 269 of the operating disk 244 is shown in its "run" position. As indicated previously, the operating handle is shown oppositely in the rinse position in the cross-section view of FIG. 9 in which it is possible to have rinse water now flow through the concentrate control vlave back out the concentrate passage to the out-of-concentrate sensor and from there to the dispensing nozzle of the machine.

The top housing section 240 is constructed in a similar manner to the bottom housing section 242 and also thus includes a locating pin 261 and locating hole 260. There is also provided at the side of the housing facing the control disk 244, a special configuration O-ring seal 274. The top housing section 240 also likewise includes oppositely disposed slides 275 that are again adapted to be received by the tracks formed in the securing clip 248. In this regard, refer in FIG. 10 to the tracks 276. Also refer to the cross-sectional view of FIG. 5 showing the manner in which the tracks of the clip 248 engage with both the slides 268 and 275.

The clip 248 is meant to be in a secured position engaged with the slides 268 and 275 with their being no sliding motion in actual operation once the housing sections and clip are secured together. Of course, the operating disk 244 is also secured between the housing sections and has its front operating handle 269 extending through the front slot 278 in the clip 248. Refer to FIG. 10.

In the cross-sectional view of FIG. 9, also refer to the top housing section 240 which is adapted to carry a top inlet port 280 that is adapted to communicate with the top concentrate passage in the top housing section 240. The connection between the adapter 75 in the inlet port 280 is by means of a flexible connector 282 also illustrated in FIG. 9. It is noted in the cross-sectional view of FIG. 9, because of the position of the rinse passage 272, there is a blockage of any flow from the bag-in-box to the concentrate control valve. However, also refer to the cross-sectional view of FIG. 5 which shows the position of the concentrate control valve when in a "run" mode of operation. It is noted in this mode of operation that the passage 270 in the control disk 244 is now in alignment with like passages coupling from the inlet port 280 to the lower port 257. In this particular position illustrated in the cross-sectional view of FIG. 5, the concentrate is free to flow through the concentrate control valve to the base 246 and from there to the out-of-concentrate sensor 200. In this regard in FIG. 5 as well as in FIG. 9, note the electrode E1 that is disposed just below the vertically arranged passage in the concentrate control valve. Also note in FIGS. 5 and 9 the horizontal passage 205 in the out-of-concentrate sensor 200 that extends from the area of the electrode E1 down to the area of the electrode E2.

Reference has been made hereinbefore to the two different modes of operation of the concentrate control valve. These include a "run" and a "rinse" mode. Refer in particular to the cross-sectional view of FIG. 8. The "run" position is shown in full lines. Note the concentrate control valve disk 244 with its concentrate passage 270. This corresponds to the view of FIG. 5 in the "run" mode of operation. It is also noted that in this particular mode of operation, the rinse passage is at a position A so that there is no rinse occuring.

Figure 8:
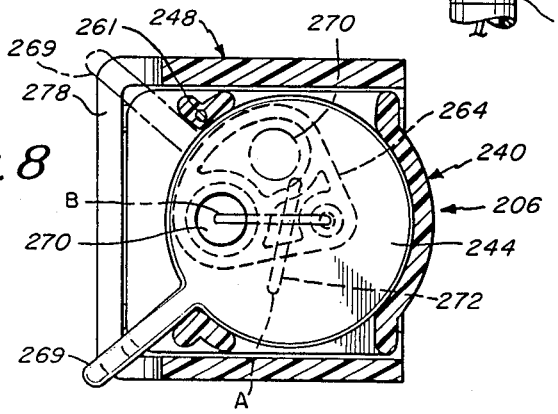
FIG. 8 is a cross-sectional view taken along line 8—8 of FIG. 6 showing further details of the concentrate control valve.

In FIG. 8 in dotted outline, there is illustrated the alternate position of the disk 244. In this position, it is noted that the concentrate passage 270 is no longer in alignment. This is not the position corresponding to FIG. 5 but instead is the position corresponding to FIG. 9 illustrated herein. In that particular position, it is noted that the rinse passage at B is now in alignment providing coupling from the rinse line 210 to the port 257. This is also clearly illustrated in FIG. 9.

Now, reference is made to the operation of the slide member 250 as it is used in providing for quick-disconnect at the concentrate control valve. This disconnection occurs essentially between the base 246 supporting the slide member and the rest of the concentrate control valve thereabove including the clip that is used to support the top and bottom housing sections as well as the disk 244. In FIG. 6 the slide 250 is in its innermost position. The side followers 279 (see FIG. 10) associated with the clip 248 have interlocked with the ramps 256 and as a matter of fact as illustrated in FIG. 6 are disposed at the bottom straight section of one of the ramps so that the followers 279 interlock with the slide member. Also note the interlocking illustrated in FIG. 5. Note the follower 279 in FIG. 5 interlocking with the ramp construction. When this occurs, both of the ports 257 and 258 are forced into the accommodating passage in the base 246. This is also the position illustrated in FIG. 9 in which it is noted that the slide 250 is in its more innermost position.

Now, to provide for a quick-disconnect of the concentrate control valve, the handle 251 of the slide member 250 may be moved in the direction of the arrow 285 illustrated in FIG. 7. The followers 279 then slide up the ramp 256. It is noted that there are opposed ramps 256 on either side such as illustrated in FIGS. 6 and 7 so that this causes the followers 279 secured to the clip 248 to move the entire clip and the entire assembly held thereby to an upward position. Note in FIG. 7 that when this action is completed, the O-rings 259 associated with the ports 257 and 258 simply sit on the top of the base 246. In the position illustrated in FIG. 7 then, the top part of the concentrate control valve is simply in a position to be readily lifted off of the base. It is furthermore noted that in a particular relative position of the slide member 250 and the clip 248, the followers 279 are in a position to also be easily lifted past the ramps 256.

Reference is also now made to the cross-sectional view of FIG. 9. In this regard, a discussion has been made previously of the out-of-concentrate sensor 200. This includes an end 204 supporting the electrode E1 coupling to a horizontal passage 205. This in turn connects to the opposite end 201 of the sensor forming a vertical passage. The electrode E2 in the form of a probe with a pointed tip is suported above the vertical passage 201. This is adapted to contact the shelf at 78 as is illustrated in FIG. 9. The sensor also includes a cap member 290 that actually supports the electrode E2 and that has associated therewith an O-ring 292. The outlet side 201 of the sensor couples to the manifold 266 and from there to the pump 212. Thus, the out-of-concentrate sensor is on the inlet side of the pump 212.

In the particular situation illustrated in FIG. 9, it is noted that the sensor 200 has liquid shown to a level in which both the electrodes E1 and E2 are covered. However, upon dispensing a slightly greater amount of liquid, the electrode E2 becomes uncovered and this then is used to indicate an out-of-concentrate or out-of-syrup condition.

In the out-of-concentrate sensor depicted in detail in FIG. 9, it is noted that the electrode E2 and its associated probe has a pointed end 400. At the beginning of the taper at 401 it is noted that it is substantially in alignment with the top of the passage 205. The very tip of the pointed end 400 is disposed at about the bottom of the horizontal passage 205. The probe is preferably in vertical alignment with the outlet 201.

In the view of FIG. 9, there is illustrated a condition in which the concentrate is about out. However, under normal operating conditions the passage 205 may be substantially filled with concentrate. However, there is always some type of a small air bubble or space in the compartment 402 disposed about the probe and over the passage 205.

Figure 13:
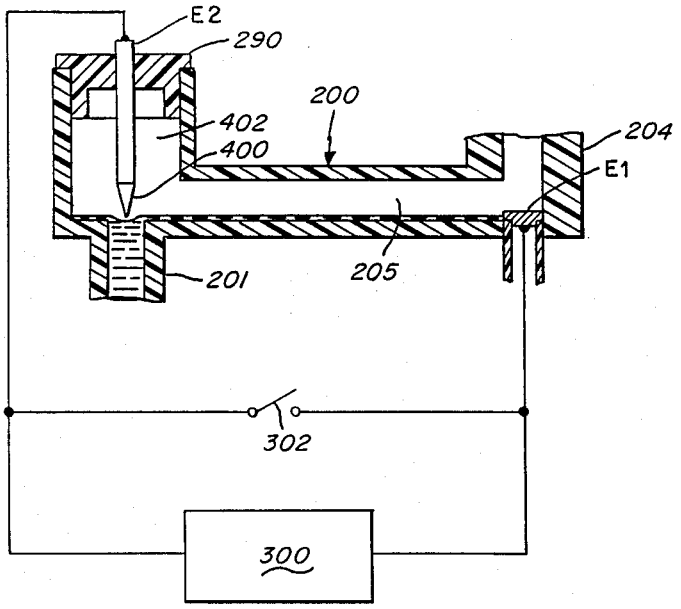
FIG. 13 is a somewhat schematic diagram also including the prime switch illustrating the details of priming for initiation of operation.

With respect to the out-of-concentrate sensor, also refer to FIG. 13. FIG. 13 illustrates somewhat more schematically the sensor with its electrodes E1 and E2. Also illustrated is the horizontal passage at 205 and a vertical passage at 201. It is noted that the electrode E2 is essentially disposed at the junction between the horizontal and vertical passages. FIG. 13 also shows the situation in which the liquid has been depleted to a point where the electrode E2 is uncovered. When this occurs, there is an indication to the electronics at box 300. The electronics senses a change in impedance between electrodes E1 and E2. When there is a liquid between these electrodes, there is a predetermined impedance therebetween. However, when one of the electrodes is uncovered, such as illustrated in FIG. 13, then the impedance between the electrodes increases substantially and this is sensed by the electronics 300. In this regard, refer to the previously referenced U.S. Pat. No. 4,645,095. This prior U.S. patent describes circuitry that may be used for the electronics 300.

Also illustrated in FIG. 13 is the prime switch 302. Also note the location of the prime switch 302 in FIG. 2. It is noted that the prime switch is essentially coupled in parallel with the electrodes E1 and E2. Thus, when the prime switch 302 is closed, this signals the electronics 300 with a low impedance signal essentially bypassing the electrodes. This causes the pump to operate for as long as the prime switch 302 is closed. Once the electrodes E1 and E2 are covered, then the prime switch 302 can be moved to its open position as illustrated in FIG. 13. The electronics 300 then operate thereafter on the basis of detecting the impedance between the electrodes E1 and E2. When the container becomes empty and the electrode E2 becomes uncovered, then the electronics 300 senses this and turns the machine off. Once a new container is substituted, then the prime switch 302 is used to prime the pump essentially causing liquid to cover the electrodes so that automatic operation can occur thereafter.

Reference is also now made to FIGS. 11 and 12. FIG. 11 shows the bag-in-box container with its outlet at 71. Before being put into use, the outlet 71 may be covered with a cap 71A so that the liquid can be held in a sealed condition. The cap 71A may then be removed and the adapter 75 with the concentrate control valve secured thereto is then inserted into the outlet 71. It is noted that only the top part of the concentrate control valve is now engaged with the adapter 75. Note the flexible coupling 282 intercoupling the adapter 75 with the concentrate control valve 206. In this particular position, the concentrate control valve is also essentially closed or in otherwise in its "rinse" position. In the "rinse" position of the valve, the concentrate control passage is closed. Also refer to the cross-sectional view of FIG. 9 showing the blocking of the concentrate control valve because of the position of the concentrate control valve disk 244. It is furthermore noted in the schematic view of FIG. 11 that the bag-in-box is essentially in its inverted position from that in use in the machine. In FIG. 12 the machine is shown in a partially broken away side elevation view with the container now turned over so that the concentrate control valve 206 can now be engaged with the valve base 246.

As the bag-in-box container 32 is disposed in the machine as illustrated in FIG. 12, it is noted that the adapter, previously interlocked with the outlet 71, passes through a cutout in the tray. The valve 206 is maintained in its closed position so that there is no leakage from the container. Because of the tilt of the container, the concentrate control valve pivots back slightly. The slide member 250 is maintained in the position of FIG. 7. The ports 257 and 258 rest on their respective passages of the base 246. The follower 279 is between the ramps 256 of the slide member. In this particular position, the slide member 250 may then be moved rearwardly toward the position of FIG. 6. The followers 279 follow the ramps and the concentrate control valve becomes interlocked with its base as the slide member 250 is moved inwardly toward the position of FIG. 6. Note that in FIG. 6 there is essentially little or no space between the clip 248 and the slide member 250. The O-rings 259 are thus deep within the passages in the base. In this regard, refer to FIGS. 5 and 9. The concentrate control valve may have to be displaced slightly forwardly so that it can be initially moved to the position of FIG. 7 so that the slide member can then be operated.

Essentially, the reverse operation occurs when one desires to remove the container. The slide member is then moved toward the position of FIG. 7 so that the slide member operates the followers 279 to push the concentrate control valve up and away from its accommodating base. Once in the position of FIG. 7 then the container with the concentrate control valve secured thereto can easily be lifted from the machine. Essentially, the view of FIG. 12 could be considered as a view in which the container is about to move into the machine or one in which the container has just slightly now been moved out of the machine after having quick-disconnected the concentrate control valve. In removing the container, of course, the valve is also to be closed so as to prevent any spillage.

In the operation of the unit, to start the unit, which will not run unless there is concentrate in the concentrate sensor, a prime switch for each side is mounted in the control compartment at the bottom of the inner door. The appropriate button (prime switch) is pressed for starting the pump. In a short period of time, concentrate reaches the sensor and then flows out the nozzle indicating that is is primed and ready for dispensing. At the same time, the out-of-concentrate light on the door goes out indicating that the unit is now ready to dispense.

As indicated previously, one of the features of the present invention is the quick-disconnect operation of the concentrate control valve. This enables one to very easily manipulate the slide member to either lock the concentrate control valve to the base or to unlock it from the base to permit removal and replacement of the bag-in-box container. Furthermore, the parts comprising the concentrate control valve are constructed so that they can be readily disassembled for cleaning. This can furthermore be accomplished without requiring any special tools. As previously described, the concentrate control valve is locked and unlocked with its base by operation of the slide member. Furthermore, the clip 248 may be operated and essentially slid relative to the top and bottom housing sections so as to enable separation of the housing sections for cleaning thereof; as well as cleaning of the concentrate control valve disk. The base 246, once the concentrate control valve is removed, can be readily cleaned. Alternatively, the base 246 may be constructed to be forceably disengaged with the out-of-concentrate sensor.

Having now described one preferred embodiment of the present invention, it is now apparent to those skilled in the art that numerous other embodiments and modifications thereof are contemplated as falling within the scope of the present invention as defined by the appended claims.

What is claimed is:

1. A beverage dispenser comprising:

a housing including a base and an insulated cabinet on the base, an ice bath at the rear of the cabinet and at least one concentrate container in the front of the cabinet, said concentrate container comprising a rigid box member having supported therein a liquid tight bag member for storing the concentrate and having coupling therefrom an outlet member, a beverage discharge assembly including a mixing block and a dispensing nozzle, means coupling potable water to the mixing block, a pump means supported in the housing between the outlet member and the mixing block, a concentrate control valve for coupling the container outlet member to the pump means, said concentrate control valve comprising separate quick-disconnect members including a first base member held stationary in the housing and a second member adapted to be held to the container outlet member for quick-disconnect mating with the first member, an out-of-concentrate sensor downstream of said control valve having a pair of spacedly disposed electrodes and means for sensing the impedance between the electrodes, said out-of-concentrate sensor includes means defining a first passage with one electrode disposed at one end thereof and means defining a second passage with a second electrode disposed at the junction between said first and second passages, said first and second passages being disposed at substantially orthogonal directions to each other, said second electrode comprising a probe electrode having a free downwardly depending end extending substantially transverse to said first passage and substantially parallel to and disposed over said second passage.

2. A beverage dispenser as set forth in claim 1 including a pair of concentrate containers each including a rigid box member and liquid tight bag member.

3. A beverage dispenser as set forth in claim 2 wherein said insulated cabinet has a hinged front door for opening and closing the front of the cabinet.

4. A beverage dispenser as set forth in claim 3 including a shelf in the cabinet for supporting the containers, such shelf having open access means for receiving said outlet members of each container.

5. A beverage dispenser as set forth in claim 1 further including a refrigeration system including a compressor and condenser in the base and an evaporator in the ice bath for reducing the temperature of water in the bath.

6. A beverage dispenser as set forth in claim 5 further including a potable water circuit including an inlet for connecting a water source to the dispenser and a cooling coil for cooling the potable water.

7. A beverage dispenser as set forth in claim 6 further including an air cooling coil forming a part of the refrigeration system in series with the potable water evaporator in the bath and disposed outside of the bath in the cabinet.

8. A beverage dispenser as set forth in claim 7 including a fan in the cabinet for circulating air in the cabinet over the air cooling coil and about the concentrate containers in the cabinet to maintain the temperature of the concentrates in the cabinet at a selected level.

9. A beverage dispenser as set forth in claim 1 wherein said out-of-concentrate sensor has a sensor housing defining said passages therein, said probe electrode disposed substantially vertically so that the concentrate may break therefrom by gravity, said sensor housing having means defining a small compartment disposed about said probe electrode and over said second passage.

10. A beverage dispenser as set forth in claim 9 wherein said probe electrode is disposed coaxial with said second passage.

11. A beverage dispenser as set forth in claim 10 wherein said pump means maintains a partial liquid vacant space in said small compartment about said probe electrode.

12. A beverage dispenser as set forth in claim 11 wherein said probe electrode has a tapered end extending in the direction of said second passage.

13. A beverage dispenser as set forth in claim 12 wherein said out-of-concentrate sensor further includes a cap and a seal means in part defining said small compartment.

14. A beverage dispenser comprising;

a housing including a base and an insulated cabinet on the base, an ice bath at the rear of the cabinet and at least one concentrate container in the front of the cabinet, said concentrate container comprising a rigid box member having supported therein a liquid tight bag member for storing the concentrate and having coupling therefrom an outlet member, a beverage discharge assembly including a mixing block and a dispensing nozzle, means coupling potable water to the mixing block, a pump means supported in the housing between the outlet member and the mixing block, a concentrate control valve for coupling the container outlet member to the pump means, said concentrate control valve comprising separate quick-disconnect members including a first base member held stationary in the housing and a second member adapted to be held to the container outlet member for quick-disconnect mating with the first member, wherein said second member includes top and bottom housing sections having supported therebetween an operating member including a control disk having a concentrate passage therein, means for holding the top and bottom housing sections together integrally with the control disk, means operatively co-acting between said first and second members and including a slide member having separate positions including one position in which the first and second members are interlocked in liquid tight relative position and a second position in which the second member is separated from the first member for quick disconnection.

15. A beverage dispenser as set forth in claim 14 wherein said control disk also has a rinse passage.

16. A beverage dispenser as set forth in claim 15 wherein both said top and bottom housing sections include O-ring seals.

17. A beverage dispenser as set forth in claim 14 wherein said slide member includes a ramp means.

18. A beverage dispenser as set forth in claim 17 wherein said operatively co-acting means comprises a securing clip having follower means associated with said ramp means.

19. A beverage dispenser comprising, a housing including a base and an insulated cabinet on the base, a concentrate container that is comprised of a rigid box member having supported therein a liquid-tight bag member for storing the concentrate and having coupling therefrom an outlet member, a beverage discharge assembly, a concentrate pump, a concentrate control valve for coupling from the container outlet member to the pump, said concentrate control valve comprising separate quick-disconnect members including a first member having a base held stationary in the housing and a second member adapted to be held to the container outlet member for quick-disconnect mating with the first member, an out-of-concentrate sensor downstream of said control valve having a pair of spacedly disposed electrodes, said out-of-concentrate sensor including means defining a first passage with one electrode disposed at one end thereof and means defining a second passage with a second electrode disposed at the junction between said first and second passages, said first and second passages being disposed at substantially orthogonal directions to each other, said second electrode including a probe electrode having a free downwardly depending end disposed over said second passage, over said concentrate pump being disposed in a position forward of said outlet member.

20. A beverage dispenser as set forth in claim 19 including a tray for supporting said container and having means contacting said second electrode to electrically reference the second electrode and tray at the same reference voltage.

21. A beverage dispenser as set forth in claim 19 including a pair of concentrate containers each including a rigid box member and liquid tight bag member.

22. A beverage dispenser as set forth in claim 21 wherein said insulated cabinet has a hinged front door for opening and closing the front of the cabinet.

23. A beverage dispenser as set forth in claim 22 including a shelf in the cabinet for supporting the containers, such shelf having open access means for receiving said outlet members of each container.

24. A beverage dispenser as set forth in claim 19 further including a refrigeration system including an ice bath, a compressor, and a condenser in the base, and an evaporator in the ice bath.

25. A beverage dispenser as set forth in claim 24 further including a potable water circuit including an inlet for connecting a water source to the dispenser and a cooling coil in the ice bath for cooling the potable water.

26. A beverage dispenser as set forth in claim 25 further including an air cooling coil forming a part of the refrigeration system in series with the evaporator in the bath and disposed outside of the bath in the cabinet.

27. A beverage dispenser as set forth in claim 26 including a fan in the cabinet for circulating air in the cabinet over the air cooling coil and about the concentrate containers in the cabinet to maintain the temperature of the concentrates in the cabinet at a selected level.

28. A beverage dispenser comprising:

a housing, a liquid container for concentrate or the like, a beverage discharge assembly including a dispensing nozzle, a pump means supported in the housing, a concentrate control valve for coupling an outlet of the container to the pump means, and an out-of-concentrate sensor downstream of said control valve having a pair of spacedly disposed electrodes, said sensor including means defining a first passage with one electrode disposed at one end thereof and means defining a second passage with a second electrode disposed at the junction between said first and second passages, said first and second passages being disposed at substantially orthogonal directions to each other, said second electrode comprising a probe electrode having a free downwardly depending end extending substantially transverse to said first passage and substantially parallel to and disposed over said second passage.

29. A beverage dispenser comprising;

a housing, a liquid container for concentrate or the like, a beverage discharge assembly including a dispensing nozzle, a pump means supported in the housing, a concentrate control valve for coupling an outlet of the container to the pump means, said control valve comprising separate quick disconnect members including a first base member held stationary in the housing and a second member adapted to be held to the container outlet for quick disconnect mating with the first member, said second member including top and bottom housing sections having supported therebetween an operating member, means for holding the top and bottom housing sections together, and means operatively coacting between said first and second members and including a slide member having separate positions including one position in which said first and second members are interlocked in liquid-tight relative position and a second position in which said second member is separated from said first member for quick disconnection.

* * * * *